8-108.1 SR
F6966 XR 4,008,120

United States Patent [19]
Carles et al.
[11] 4,008,120
[45] Feb. 15, 1977

[54] PROCESS OF DELIGNIFICATION AND BLEACHING A LIGNOCELLULOSE PRODUCT

[75] Inventors: Jacques E. Carles; Louis J. Bergé, both of Saint Gaudens, France

[73] Assignee: Groupement Europeen De La Cellulose, Paris, France

[22] Filed: Dec. 18, 1974

[21] Appl. No.: 533,774

[30] Foreign Application Priority Data

Dec. 21, 1973 France ..... 73.45930

[52] U.S. Cl. ..... 162/89; 8/108 R; 8/108 A; 162/87; 162/88; 162/90

[51] Int. Cl.[2] ..... D21C 9/12; D21C 9/14

[58] Field of Search ..... 162/63, 65, 78, 87, 162/88, 89, 81, 90; 8/107, 108, 109, 111, 108 R, 108 A

[56] References Cited

UNITED STATES PATENTS

| | | | |
|---|---|---|---|
| 1,736,080 | 11/1929 | Heimann et al. | 162/65 |
| 2,465,327 | 3/1949 | McEwen | 162/78 X |
| 3,423,282 | 1/1969 | Rerolle et al. | 162/65 |
| 3,663,357 | 5/1972 | Liebergott | 162/65 |
| 3,719,552 | 3/1973 | Farley et al. | 162/65 |
| 3,806,404 | 4/1974 | Liebergott et al. | 162/65 |
| 3,865,685 | 2/1975 | Hebbel et al. | 162/78 |

OTHER PUBLICATIONS

A.P.C., Application of Scheller et al., Ser. No. 303,913, Published July 13, 1943. 162–178.

*Primary Examiner*—S. Leon Bayshore
*Assistant Examiner*—Arthur L. Corbin
*Attorney, Agent, or Firm*—Lewis H. Eslinger

[57] ABSTRACT

The delignification and bleaching of lignocellulosic products is effected by mixing an aqueous suspension of the lignocellulosic product with a chlorine-containing substance and an oxygen-containing substance, simultaneously or sequentially, and they, by reaction in situ, give rise to gases in the nascent state. The chlorine and/or oxygen are in the so-called "singlet" state, or in a state of higher energy. The treatment occurs at a temperature below 100° C and for a time less than 60 minutes.

12 Claims, No Drawings

PROCESS OF DELIGNIFICATION AND BLEACHING A LIGNOCELLULOSE PRODUCT

The present invention relates to the delignification and bleaching of lignocellulose pulps.

Hitherto the delignification and bleaching of lignocellulose pulps was carried out in several steps by means of chemical agents the most usual of which are: chlorine, soda, sodium or calcium hypochlorite, chlorine dioxide, the peroxides of hydrogen or of sodium and, more recently, oxygen in an alkaline medium.

These operations are customarily carried out in aqueous suspension and necessitate relatively long times of treatment, often several hours. In the case of oxygen the bleaching is carried out with a high concentration of pulp (about 20%) and under pressure.

Accordingly, it is a general object of the present invention to provide a process for the delignification and bleaching of lignocellulose pulp which overcomes such drawbacks of previous processes.

It is one object of the present invention to provide a process for the delignification and bleaching of lignocellulose pulp which only necessitates a very simple technology.

It is another object to provide a process of delignifying cellulose very rapidly without degrading it.

It is a further object to provide a process which has no reaction temperature restriction, more particularly, a process which can be carried out at ambient temperature.

Another object of the invention is to reduce the number of stages compared with prior art delignification.

Yet another object is to provide a process which is operable at atmospheric pressure.

It is also an object of the invention to provide a process which produces relatively colorless effluents.

Another object of the invention is to provide a process which is applicable to bleaching in the liquid phase as in the gaseous phase.

Other objects and advantages of the invention will appear from the description which follows.

It is known that when a gas is liberated by chemical reaction, the molecules of this nascent gas occur also in a higher energy state. This is the case for example with the oxygen produced in photosensitised oxidation reactions or from the decomposition of ozonides. This excited oxygen occurs partly in the singlet state. In aqueous solution the excited molecules have a very brief life span ($10^{-3}$ to $10^{-5}$ second for the singlet oxygen). In spite of this short life span, they are extremely reactive on compounds in their environment.

It is known also that singlet oxygen oxidises double bonds and phenolic compounds, that is to say groups characteristic of lignin.

It has been discovered, according to the present invention that simple and cheap chemical systems liberating nascent gases permit the delignification and bleaching of lignocellulose materials very rapidly and without degradation of the cellulose.

According to the invention there is provided a process for the delignification and bleaching of lignocellulose pulps by means of chlorinated and/or oxygenated compounds, characterised in that the pulp is mixed with the chlorinated and/or oxygenated compounds, which, by reaction in situ give rise to gases in the excited state, the chlorine and/or the oxygen occurring in the so-called "singlet" state or in a higher energy state.

Such chlorine containing and/or oxygen containing compounds constitute oxidising systems of which those preferred for practising the present invention are:

sodium or calcium hypochlorite/carbon dioxide
sodium or calcium hypochlorite/hydrogen peroxide
chlorine water/sodium carbonate.

Other systems which may be used to give equivalent results are: nitrogen oxide/ozone, photolytic oxygen, superoxide decomposition systems, etc. . . . however their use remains conditioned by the present prohibitive cost either of the systems or of the energy required.

The chemical reactions involved in the preferred systems are:

$$2NaOCl + CO_2 \longrightarrow Na_2CO_3 + \tfrac{1}{2} O_2 + Cl_2 \quad (1)$$

$$NaOCl + H_2O_2 \longrightarrow NaCl + O_2 + H_2O \quad (2)$$

$$2Cl_2 + Na_2CO_3 \longrightarrow 2NaCl + Cl_2O + CO_2 \quad (3)$$

$$Cl_2 + Na_2CO_3 \longrightarrow NaOCl + CO_2 + NaCl \longrightarrow \tfrac{1}{2} Na_2CO_3 + \tfrac{1}{4} O_2 + \tfrac{1}{2} Cl_2 + NaCl + \tfrac{1}{2} CO_2$$

When one of the compounds of the system is gaseous, the latter may be introduced into the reaction mixture in the gaseous form by diffusion into the suspension of pulp containing the other compound of the system, either again in solution form, (for example a supersaturated solution of carbon dioxide gas or chlorine water), or again in the gaseous form into the pulp at high consistency and fluffed so as to effect the bleaching in the gaseous phase.

The process of delignification according to the invention may be applied to chemical, semi-chemical or mechanical pulps produced by various existing industrial processes.

The reaction or liberation of the one or more activated gases is carried out in situ in the fibrous suspension.

The two components of the chemical system producing the one or more delignifying gases are introduced and mixed with the pulp, either simultaneously or at separate times. The second method generally gives better results.

The amounts of reactants to be used must correspond to the chlorine (or oxygen) demand of the pulp as determined by the various methods customarily used by the technician skilled in the art (Roe index or Kappa index). The proportions of reactants should preferentially be between 80 and 120% of the chlorine demand.

The duration of the treatment after mixing the constituents of the chemical system and the pulp must be less than one hour and preferably less than 20 minutes.

The delignification by the treatment concerned is carried out at a temperature below 100°, preferably between 20° and 60° C.

The preferred systems are constituted by the pairs $NaOCl/CO_2$, $Ca(OCl)_2/CO_2$, $NaOCl/H_2O_2$ and $Cl_2/Na_2CO_3$.

The choice of system is dictated by the nature of the pulp to be treated and the economic considerations imposed on the user.

The concentration of pulp in the fibrous suspension can vary between 2 and 40%, preferentially it is between 20 and 30% for bleaching in the gaseous phase, between 3 and 14% for bleaching in the liquid phase. The choice of concentration is to be determined particularly according to the facilities available to the user.

According to the particular cases, particular advantages can be obtained. For example, with the systems of which one of the components is NaOCl or Ca $(OCl)_2$, the fact of decomposing the hypochlorite into active chlorine and active oxygen has the following advantages over conventional treatment with hypochlorite: it is unnecessary to maintain the pH at 8.5 and to slow down the oxidation reaction. Instead of carrying out the delignification in several hours the $NaOCl/CO_2$ system for example permits superior results (Kappa index lower for the treated pulp) in some minutes. Moreover, the final pH of the liquors is close to neutrality, which favors possible recycling. Finally, the rapid kinetics of the reaction avoids the customary degradation encountered at these pHs with hypochlorite.

In order that the invention may be more fully understood a number of examples of its practice are given below purely by way of illustration and not to be regarded as limiting the scope of the invention.

EXAMPLE 1

A kraft pulp of washed feuillus (leaf-bearing wood), of kappa index 21.8, is delignified with the system $NaOCl/CO_2$ under the following conditions:

| | |
|---|---|
| Treatment time | 1 minute |
| % NaOCl (in $Cl_2$) | 4.425% |
| Pulp concentration | 3.5% |
| Temperature | 25° C |
| $CO_2$ flow-rate | 3 l/min. per 100 g of pulp. |

The characteristics of the washed pulp after treatment are then:

| | |
|---|---|
| Yield | 96.9 |
| Brightness | 39.6 |
| Kappa index | 6.4 |
| Degree of polymerisation | 1125 |
| Final pH | 6.6 |

The pulp thus delignified in 1 minute may then be fully bleached or half-bleached by means of various conventional bleaching states according to the purposes contemplated by the user.

It is to be noted that the fact of carrying out this delignification in a very short time avoids any degradation of the cellulose chains as is indicated by measurement of the degree of polymerisation.

EXAMPLE 2

An industrial kraft wood pulp of kappa index 14.1 is treated with the system $Cl_2/Na_2CO_3$ under the following conditions:

TABLE I

| No | 1 | 2 | 3 | 4 | 5 |
|---|---|---|---|---|---|
| Reaction time | 5 min. | 5 min. | 2 min. | 5 min. | 9 min. |
| % Chlorine | 2.70 | 3.78 | 3.78 | 2.70 | 2.7 |

TABLE I-continued

| No | 1 | 2 | 3 | 4 | 5 |
|---|---|---|---|---|---|
| % $Na_2CO_3$ | 4.03 | 5.64 | 5.64 | 4.03 | 4.03 |
| Temperature ° C | 25 | 40 | 40 | 40 | 50 |

Concentration of the pulp 3.5%

The characteristics obtained with this treatment in one stage are given by Table II.

TABLE II

| No | 1 | 2 | 3 | 4 | 5 |
|---|---|---|---|---|---|
| Kappa index | 6.3 | 5.5 | 5.4 | 5.1 | 4.5 |
| Yield | 98.4 | 98.5 | 98.7 | 98.3 | 97.5 |
| Brightness | 40.4 | 44.7 | 43.9 | 45.7 | 48.2 |
| Final pH | 6.5 | 6.4 | 6.6 | 6.5 | 6.4 |

The pulps obtained can then be fully bleached in three DED phases with the appropriate amounts of reactants for the Kappa indices obtained according to the customary technique of the technician skilled in the art. By way of comparison the same pulp bleached by chlorination and then conventional sodation with 2.70% $Cl_2$ and 1.4% NaOH using durations respectively of 40 minutes and 60 minutes for each stage gives a pulp of kappa index 4.6 and brightness 41.8.

EXAMPLE 3

The same pulp as that used in Example 2 was delignified with the system $NaOCl/CO_2$ by using the following conditions:

TABLE III

| No | 1 | 2 | 3 | 4 | 5 |
|---|---|---|---|---|---|
| Reaction time | 5 min. | 5 min. | 2 min. | 5 min. | 5 min. |
| % NaOCl (expressed in $Cl_2$) | 3.78 | 2.7 | 3.78 | 3.78 | 2.7 |
| Temperature in ° C | 25 | 40 | 40 | 40 | 55 |
| $CO_2$ flow-rate l/min/100 g pulp | 3 | 3 | 3 | 3 | 3 |

The results obtained (Table IV) confirm the fact that several chemical systems A/B giving rise in situ to delignifying gases may be used to produce similar effects.

TABLE IV

| No | 1 | 2 | 3 | 4 | 5 |
|---|---|---|---|---|---|
| Kappa index | 5.4 | 5.5 | 4.8 | 4.4 | 5.0 |
| Yield | 98.7 | 98.2 | 97.2 | 96.8 | 97.6 |
| Brightness | 42.7 | 44.2 | 48.5 | 50.9 | 48.1 |
| Final pH | 6.1 | 6.0 | 6,2 | 6.1 | 6.3 |

EXAMPLE 4

A kraft chemical pulp obtained from a mixture of fir wood was bleached according to the invention by using the $NaOCl/CO_2$ system under the following conditions:

| | |
|---|---|
| Reaction time | 5 min. |
| Pulp concentration | 3.5% |
| Temperature | 25° C |
| $CO_2$ flow-rate | 3 l/min/100 g pulp |
| % NaOCl (expressed in $Cl_2$) | 6.195% |

The pulp was washed thoroughly and had an initial kappa index of 21.8.

The same pulp was treated in a parallel manner in two conventional stages: chlorination then sodation under the following conditions:

| | | |
|---|---|---|
| 1. | Chlorination | reaction time 40 min.<br>temperature 25° C<br>pulp concentration 3.5%<br>% chlorine 4.425% |
| 2. | Sodation: | reaction time 120 min.<br>temperature 45° C<br>pulp concentration 12%<br>% NaOH 1.78 |

The properties of the pulp and of the effluents were compared for the two treatments in the Table:

TABLE V

| | | Chlorination + sodation (conventional CE) | $NaOCl/CO_2$ according to the invention |
|---|---|---|---|
| PULP | Kappa index | 4.15 | 4.73 |
| | Yield | 94.6 | 96.00 |
| EFFLUENT | pH | Chlorination: 2.07<br>Sodation 11.3 | 6.1 |
| | $Cl_2$ remaining | Chlorination 0.35% | 0.20 |

The two batches of pulp obtained were then bleached in three conventional stages (DED) under the following conditions identical for the two pulps.

| | |
|---|---|
| First chlorine dioxide stage: | $\%ClO_2 = 1.2\%$ |
| Soda extraction: | % NaOH = 0.6% |
| Second chlorine dioxide stage: | $\%ClO_2 = 0.6\%$ |

The two whitened pulps were comparable as is seen from Table VI.

TABLE VI

| | Conventional bleaching 1 EDED | $NaOCl/CO_2$ bleaching H DED |
|---|---|---|
| Brightness | 89.7 | 88.5 |
| Yield | 95.6 | 94.5 |
| Degree of polymerisation (AFNOR) | 1072 | 1020 |

H for $NaOCl/CO_2$

EXAMPLE 5

A kraft feuillus pulp bleached with oxygen of kappa 7.1 and of brightness 40.1 was treated with a system $Cl_2/Na_2CO_3$, under the conditions of Table VII.

The properties of the treated and washed bleached pulp are also given in Table VII. Comparison with the test Chlorination + Sodation shows the advantage in brightness associated with the process according to the invention.

TABLE VII

| | | Reference C + E | $Cl_2/Na_2CO_3$ (Cl*) | | | | | | |
|---|---|---|---|---|---|---|---|---|---|
| Pulp concentration | | 3.5% | 3.5% | | | | | | |
| Chlorination | T | 40° | 25° | 25° | 25° | 45° | 45° | 45° |
| | t(minutes) | 20 | 2 | 5 | 30 | 2 | 5 | 30 |
| | $\%Cl_2$ | 1.5 | 1.5 | 1.5 | 1.5 | 1.5 | 1.5 | 1.5 |
| | $\%NaCO_3$ | 0 | 1.25 | 2.25 | 2.25 | 2.25 | 2.25 | 2.25 |
| | pH | 3.1 | 6.8 | 6.9 | 7.0 | 7.2 | 6.9 | 6.8 |
| Sodation | %NaOH | 0.84 | | | | | | |
| | ph | 11.4 | | | | | | |
| Bleached pulp | 1 kappa | 2.1 | 3.2 | 3.07 | 3.08 | 2.80 | 2.70 | 2.60 |
| Bleaching | brightness | 62.3 | 59.5 | 60.3 | 64.5 | 60.8 | 62.2 | 66.8 |

It can also be observed that at equal kappa index, the bleached pulp according to the invention is brighter. This is due to the fact that the lignin is oxidised but not completely removed. Oxidised lignin having less conjugation is hence less colored. Consequently, for pulps treated according to the invention, the kappa index has a value slightly different from that corresponding to the pulps treated in conventional manner and this appears even more in pulps treated with oxygen. In the present examples, the two effects $O_2^* + Cl_2^*$ are combined.

EXAMPLE 6

A kraft industrial pulp of kappa 14.1 is bleached in 5 minutes with the $NaOCl/CO_2$ system at 40° with 3.5% concentration of pulp and a flow-rate of 10 l/min. of $CO_2$ diffused by means of a gas diffuser into the fibrous suspension. The hypochlorite introduced is 3.78% by weight of chlorine with respect to the pulp. The kappa index after treatment drops to 4.4. The thus bleached pulp is treated in a conventional DED sequence with 1.2% $ClO_2$ for the first stage, 0.6% NaOH for the alkaline extraction and 0.6% $ClO_2$ for the second stage. The yield is 95.9 and the Elrepho brightness on a form of 2 g is 89.0. The same pulp treated by the conventional sequence C $E_I$ $D_I$ $E_{II}$ $D_{II}$

| | |
|---|---|
| $\% Cl_2$ | = 2.7 |
| % NaOH (I) | = 1.4 |
| $\% ClO_2$ I | = 1.2 |
| % NaOH (II) | = 0.6 |
| $\% ClO_2$ (II) | = 0.6 |

gives a bleached pulp with a yield of 95.5 and a brightness of 88.5.

EXAMPLE 7

A kraft pulp (kappa = 25.4) degree of polymerisation 1310 is bleached in 10 minutes with 4.60% NaOCl (expressed in $Cl_2$) with respect to the pulp at 25° C with a concentration of 15% of pulp. The fibrous suspension was placed in a bomb under 2 kg pressure of $CO_2$. After purging the $CO_2$ and washing, the pulp has a brightness of 47.2 and a D.P. of 1210.

The invention is not to be considered as limited to the embodiments described and illustrated but covers on the contrary all modifications.

We claim:

1. A process for the delignification and bleaching of lignocellulose product which comprises mixing an aqueous suspension of the product with a pair of chlorine and oxygen containing compounds which are members selected from the group of pairs consisting of $NaOCl/CO_2$, $Ca(OCl)_2/CO_2$, and $Na_2CO_3/Cl_2$, said compounds reacting in situ to release a member of the group consisting of chlorine and oxygen and mixtures thereof, which in turn react with the lignocellulose product at a temperature of less than 100° C for less than 60 minutes to delignify and bleach said product.

2. Process according to claim 1, wherein the pair of substances is sodium hypochlorite and carbon dioxide gas.

3. Process according to claim 1, wherein the pair of substances is chlorine and sodium carbonate.

4. Process according to claim 1, wherein each of said pair of substances is mixed separately with said product.

5. The process of claim 1 wherein the delignification and bleaching is carried out in less than twenty minutes.

6. A process for the delignification and bleaching of lignocellulose product which comprises mixing an aqueous suspension of the product, wherein the lignocellulose product comprises 2 to 40% of the aqueous suspension, with a pair of chlorine and oxygen containing compounds which are members selected from the group of pairs consisting of $NaOCl/CO_2$, $Ca(OCl)_2/CO_2$, and $Na_2CO_3/Cl_2$, said compounds reacting in situ to release a member of the group consisting of chlorine and oxygen and mixtures thereof, which in turn react with the lignocellulose product for less than 20 minutes and at a temperature of 20° to 60° C to delignify and bleach the product.

7. The process of claim 6 wherein the pair of compounds comprises $NaOCl/CO_2$.

8. The process of claim 6 wherein the pair of compounds comprise $Ca(OCl)_2/CO_2$.

9. The process of claim 6 wherein the compounds comprise $Cl_2/Na_2CO_3$.

10. The process of claim 6 wherein the delignification and bleaching is carried out in about 5 minutes.

11. The process of claim 6 wherein the delignification and bleaching is carried out in a gaseous phase and the lignocellulose product comprises 20 to 30% of the aqueous suspension.

12. The process of claim 6 wherein the delignification and bleaching is carried out in the liquid phase and the lignocellulose product comprises 3 to 14% of the aqueous suspension.

* * * * *